US008734039B2

(12) United States Patent
Castells et al.

(10) Patent No.: US 8,734,039 B2
(45) Date of Patent: May 27, 2014

(54) PRINT MEDIUM HANDLING

(75) Inventors: Raimon Castells, Barcelona (ES); Abel Martinez, Hospitalet de Llobregat Barcelona (ES); Laura Sanchez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1118 days.

(21) Appl. No.: 12/363,575

(22) Filed: Jan. 30, 2009

(65) Prior Publication Data

US 2010/0196076 A1 Aug. 5, 2010

(51) Int. Cl.
*B41J 15/00* (2006.01)

(52) U.S. Cl.
USPC ..... 400/618; 400/613; 400/619

(58) Field of Classification Search
USPC ..... 400/614, 618
See application file for complete search history.

(56) References Cited

U.S. PATENT DOCUMENTS

| | | | | |
|---|---|---|---|---|
| 4,732,501 | A | 3/1988 | Angst et al. | |
| 4,769,585 | A | 9/1988 | Tanuma et al. | |
| 6,356,710 | B1 * | 3/2002 | Sato et al. | 388/804 |
| 6,454,197 | B1 * | 9/2002 | Everett | 242/334.4 |
| 2004/0041047 | A1 * | 3/2004 | Karp et al. | 242/334.3 |
| 2005/0069370 | A1 * | 3/2005 | Yamada et al. | 400/663 |
| 2009/0016797 | A1 * | 1/2009 | Brugue et al. | 400/613 |

FOREIGN PATENT DOCUMENTS

| | | |
|---|---|---|
| JP | 55-030966 | 3/1980 |
| JP | 60-257264 | 12/1985 |
| JP | 02-026298 | 1/1990 |
| WO | WO-2007/030852 | 3/2007 |

* cited by examiner

*Primary Examiner* — Christopher Stanford

(57) ABSTRACT

A method of assisting in handling a print medium on a spindle, said spindle being operatively connected with a motor, said method comprising the following steps: rotating said spindle by an outside force in a first direction when handling the print medium, said rotation generating an electromotive force in said motor in a second direction, opposite to said first direction; and causing the motor to apply a torque in said first direction, said torque being proportional to the electromotive force generated in the second direction by the rotation of the spindle.

17 Claims, 5 Drawing Sheets

PRINT MEDIUM HANDLING

FIELD OF THE INVENTION

The present invention relates to a method of assisting in handling a print medium and a print medium advance mechanism.

BACKGROUND OF THE INVENTION

A printer is generally used for (re)producing text and images. Throughout this application, when reference is made to an image or images, this is to be interpreted as also explicitly referring to text (not only figures).

Different types of printers are known, amongst which laser printers, thermal printers, dot matrix printers and inkjet printers.

Inkjet printers use at least one printhead provided with a plurality of nozzles, from which ink droplets are fired or ejected onto the media; the printer controls the firing of ink from the nozzles such as to create on the media a pattern of dots corresponding to the desired image.

The print medium may be a continuous web, which is fed from a feed roll mounted on a spindle arranged in the printing apparatus upstream of the printhead and on which several different plots are printed one after the other. A motor may be operatively connected to said spindle to drive the spindle with appropriate speed when printing.

To load such a web of print medium in the printer, the feed roll is firstly mounted on the spindle. Subsequently the operator pulls on the web, which rotates the spindle and unwinds the feed roll, thus enabling the further loading of the web through the printer. When pulling on the web and causing the spindle to rotate, the motor that is connected to it starts to behave as a generator. An electromotive force is generated in the motor that opposes the rotation of the spindle. Especially in larger format printers, in which the motor connected to the spindle is more powerful, this causes a problem. A user needs to pull with both hands on the web and still may not be able to rotate the spindle sufficiently.

SUMMARY OF THE INVENTION

The present invention aims at providing a method of assisting in handling a print medium on a spindle and a print medium advance mechanism that at least partially alleviate the loading of the print medium.

According to a first aspect, the present invention relates to a method of assisting in handling a print medium on a spindle, said spindle being operatively connected with a motor, said method comprising the following steps: rotating said spindle by an outside force in a first direction when handling the print medium, said rotation generating an electromotive force in said motor in a second direction, opposite to said first direction; and causing the motor to apply a torque in said first direction, said torque being proportional to the electromotive force generated in the second direction by the rotation of the spindle.

With a print medium mounted on the spindle, the spindle is rotated by an outside force in a first direction for handling the print medium (e.g. loading of a print medium through the printer). An outside force in this sense is meant to refer to a force acting on the spindle from any source that is not the motor operatively connected to it. Said outside force may e.g. be an operator pulling on the print medium. The rotation of the spindle in a first direction causes an electromotive force in the motor in a second direction, opposing the rotation. Subsequently the motor is caused to apply a torque to the spindle in said first direction that is proportional to the electromotive force that was generated. The motor will thus act on the spindle to rotate the spindle in the direction that the operator is trying to rotate the spindle in. This allows the operator to more easily load the print medium.

According to another aspect, the present invention relates to a print medium advance mechanism for advancing a print medium, said advance mechanism comprising at least a first spindle upon which a print medium can be loaded, a first motor operatively connected to said first spindle, and a control system, said control system being adapted to determine the amount of electromotive force generated in the first motor when said first spindle is being rotated by an outside force and, said control system being adapted to, in an assisted media handling operation, cause the first motor to apply a torque proportional to said determined electromotive force.

BRIEF DESCRIPTION OF THE DRAWING

Particular embodiments of the present invention will be described in the following, only by way of non-limiting example, with reference to the appended drawings, in which.

DESCRIPTION OF THE PREFERRED EMBODIMENTS

Figure 1A:
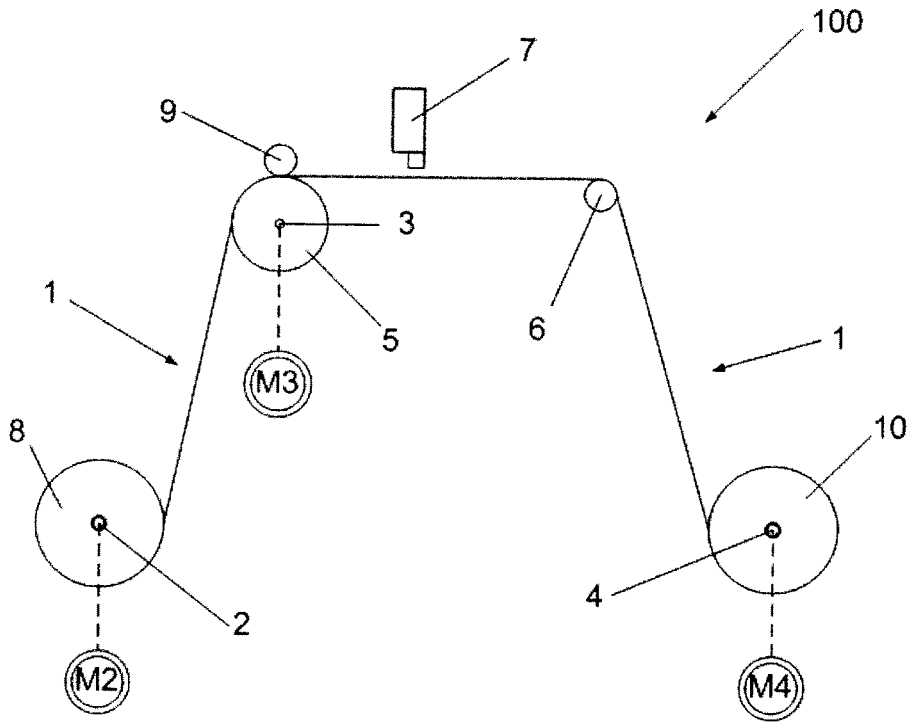
FIG. 1*a* is a schematic view of a first printer comprising a print medium advance mechanism according to an embodiment of the present invention.

FIG. 1*a* discloses a first printer 100 which comprises a print medium advance mechanism according to an embodiment of the present invention. A print medium 1 is fed to the printer from a first spindle 2. Drive roller 5, which is mounted on drive spindle 3 advances the print medium, and during printing, accurately positions medium 1 with respect to printhead 7. After passing printhead 7, the medium is redirected by passive redirecting roller 6 and is collected on a second spindle 4, which functions as a print medium take-up spindle.

The printer shown in FIG. 1*a* is a so-called large format roll-to-roll printer. This kind of printer may be used for printing large images on various kinds of media, such as textile, or paper. The printed products may e.g. be used on billboards or to mask scaffolding. The rolls of print medium used in this kind of application can be very heavy. The power of the motor driving the spindle of a roll thus has to be adjusted accordingly.

A first motor M2 is operatively connected to first spindle 2, which functions as a print medium feed spindle. A feed roll of print medium 8 is shown mounted on spindle 2.

A second motor M4 is operatively connected to second spindle 4, which serves as print medium take-up spindle. A take-up roll 10 is shown mounted on spindle 4. Furthermore, a drive motor M3 is operatively connected to spindle 3, upon which drive roller 5 is mounted. Drive roller 5 is further provided with a pinch roller 9 to provide for friction between a print medium and the drive roller. Alternative ways of providing friction may be used without departing from the scope of the present invention.

In normal operation of the printer, a drive roller 5 advances print medium 1. The drive motor M3 follows a velocity profile based on the desired image to be printed. The first and second motors operatively connected to first spindle 2 and second spindle 4 respectively follow a velocity profile which is based on the velocity profile of the drive motor.

In FIG. 1*a*, drive motor M3, first motor M2, and second motor M4, have been schematically indicated, through the use of a dotted line, to be operatively connected to their respective spindles. It is to be understood that the motors can be operatively connected to the spindles in any suitable way e.g. through suitable gearings, with or without a clutch mechanism, or by a direct connection.

The method and mechanism according to embodiments of the present invention may be used in medium handling operations in a printer such as shown in FIG. 1*a*. A medium handling operation may be e.g. the loading of a print medium (further illustrated in FIGS. 2*a*-2*d*), unloading of a print medium (further illustrated in FIG. 3) or the detection of a medium roll on a spindle (further illustrated in FIG. 5).

Figure 1B:
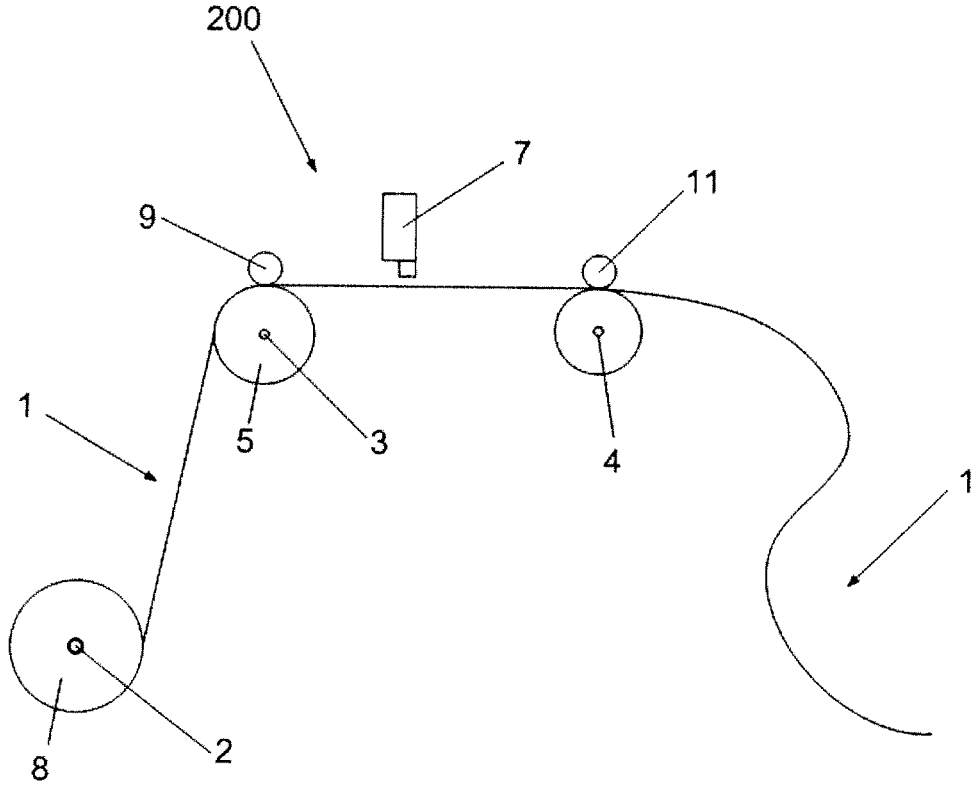
FIG. 1*b* is a schematic view of a second printer comprising a print medium advance mechanism according to an embodiment of the present invention.

In FIG. 1*b*, a slightly different printer, a so-called roll-to-floor printer is schematically shown. In this kind of printer, the print medium is not recollected on a roll. So, second spindle 4 in this printer does not function as a medium take-up spindle. Instead, its function is merely to apply appropriate tension, together with pinch roller 11, and drive roller 5 to the print medium located in the area of the printhead. In order to be able to print an accurate image, the tension of the print medium in this area has to be controlled. It should be noted, that in the roll-to-roll printer shown in FIG. 1*a*, print medium take-up spindle 4 also performs the function of applying tension to the print medium.

The method and mechanism according to embodiments of the present invention may also be used in the printer schematically shown in FIG. 1*b*. Additionally, the method and mechanism according to the present invention may be used in all printers in which a medium is supplied from or collected on a spindle.

As in the printer shown in figure la, in normal operation of printer 200, the drive roller 5 serves to accurately advance print medium 1 with respect to printhead 7. The velocity profiles followed by a first motor operatively connected to first spindle 2, and by a second motor operatively connected to second spindle 4 are based on the velocity profile of the drive roller.

In an embodiment of the present invention, the printer further has a user input interface, which allows the user to select the operational mode of the printer: a normal operation mode or an assisted media handling mode. The assisted media handling mode may be used, particularly for media loading and unloading operations. Loading the print medium in this sense is meant to refer to positioning the print medium in the print medium advance mechanism, such that the printer is ready to start printing. Loading the print medium thus may comprise e.g. placing a print medium roll on a spindle and threading a print medium in between various rollers. If the operator selects the assisted media handling mode, the control systems of the respective motors operate in a different way than under normal operation. This will be explained with an example of loading a print medium and is illustrated in FIGS. 2*a*-2*d*.

The print medium 1 in this shown example is wound on a feed roll 8 and mounted on spindle 2. The spindle is operatively connected to its motor, which at this moment is at rest. After an operator has mounted feed roll 8 on print medium feed spindle 2, he pulls on medium 1 to further manually load it in the printer. Pulling on the medium causes spindle 2 and its connected motor to rotate in a first direction (in the example shown in FIG. 2*a* the clockwise direction). This rotation causes an electromotive force in the motor in a direction opposite to the first direction. (In the example shown in FIG. 2*a*, this is thus the counterclockwise direction).

The control system of the print medium feed motor determines the amount of electromotive force generated in the motor and causes the motor to generate a torque in the first direction that is proportional to said determined electromotive force. The motor thus drives the medium feed spindle in the direction in which the operator is trying to rotate it by pulling on the medium (i.e. because of the winding direction of medium roll 8, in the clockwise direction). The method and system according to the present invention thus alleviate the medium loading process for the operator.

Figure 2A:
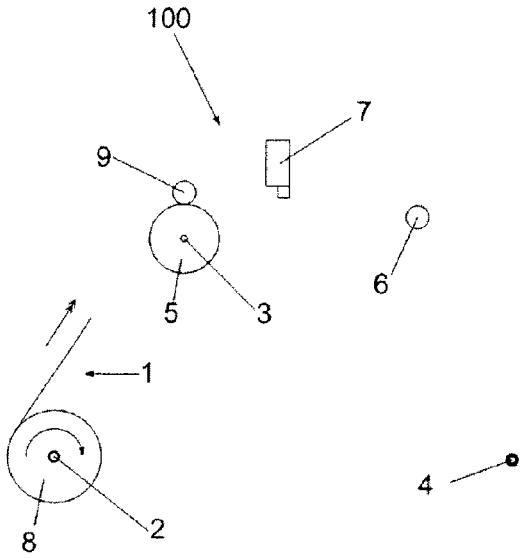
FIGS. 2*a*-2*d* illustrate a method of loading a print medium according to an embodiment of the present invention.
Figure 2B:
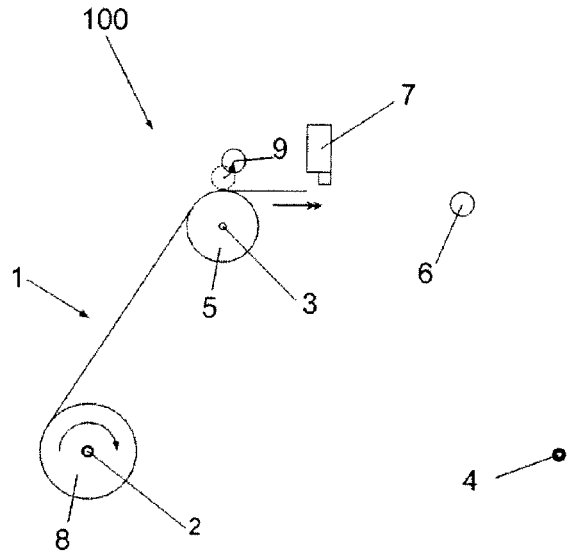
Figure 2C:
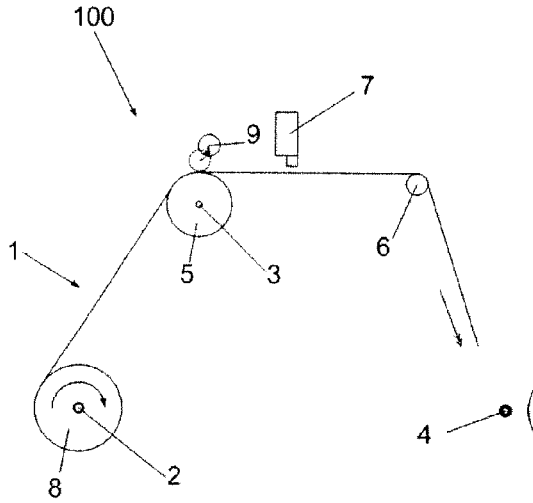
Figure 2D:
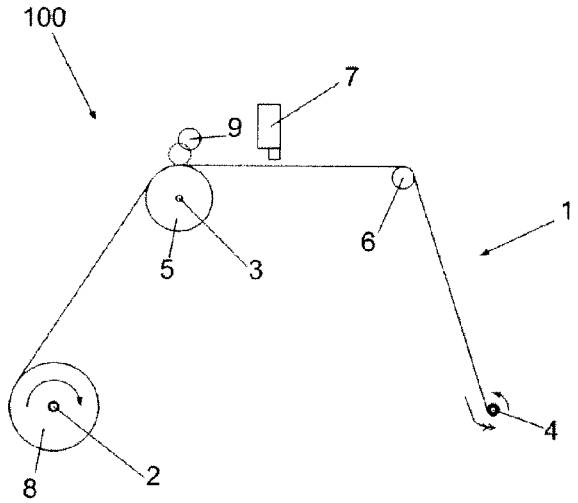

In FIGS. 2*b* and 2*c*, print medium 1 is further loaded through printer 100. To load print medium past drive roller 5, pinch roller 9 is temporarily moved to a different position (its original position shown in dotted line). Finally, as is shown in FIG. 2*d*, the print medium can also be loaded around take-up spindle 4. Also the control system of the motor connected to the take-up spindle will, in the assisted media handling mode, cause the motor to apply a torque in the appropriate direction (in this case, counterclockwise direction) helping the operator in loading the print medium.

In the embodiment described before, every motor comprises its own control system. In other embodiments of the invention however, a printer may comprise a central control system, which functions both as the first motor control system and the second motor control system, controlling every motor of the print medium advance mechanism. Alternatively, a central control system may be provided which communicates with a separate first motor control system and a separate second motor control system. Also, a control system may comprise any combination of software, hardware or firmware.

In the above example, the outside force which causes a motor to rotate comes from the operator pulling on the print medium. Within the scope of the present invention however, said outside force can also come from any other outside source. For example, a user rotating the spindle by hand, using separate handles or not, can be another such outside source. Alternatively, once the print medium is threaded between drive motor 5 and pinch roller 9, the drive motor can rotate drive roller 5, which causes the medium feed spindle (and its connected motor) to rotate. The drive motor may in this case be regarded as the outside source.

A method of assisting in handling a print medium may also be used when unloading a print medium. This will be illustrated using FIG. 3.

Figure 3:
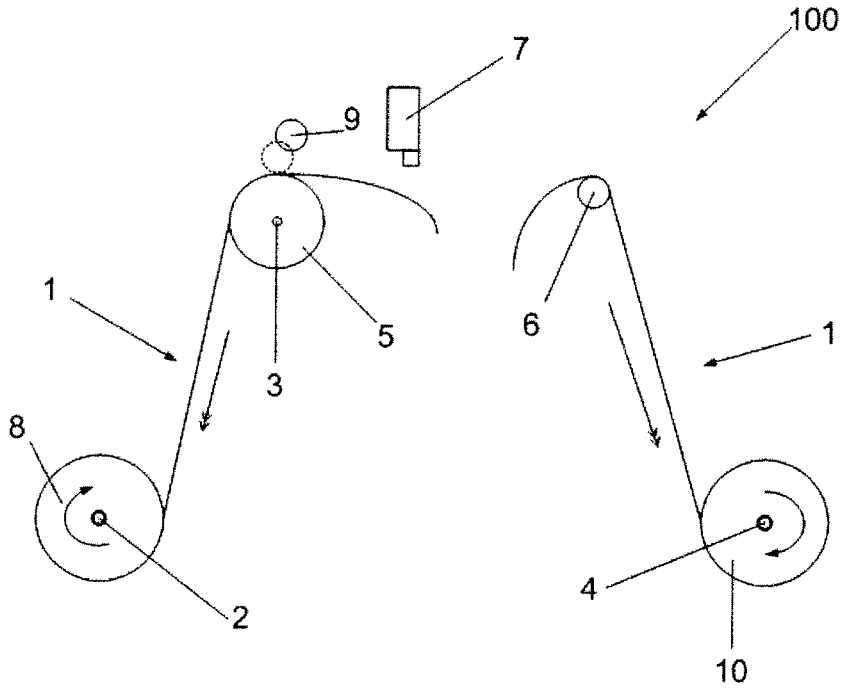
FIG. 3 illustrates a method of unloading a print medium according to an embodiment of the present invention.

FIG. 3 shows the same printer 100. A print medium is supplied from feed roll 8 mounted on feed spindle 2 and is collected after printing upon take-up roll 10 mounted on take-up spindle 4. After a print job has finished and the operator wants to change the print medium, the print medium may be cut. Subsequently, one end of the print medium may be wound on the feed roll 8 and the other end of the print medium may be wound on the take-up roll 10. The two rolls can then be taken from the printer and a new print medium may be loaded.

When winding the print medium on either the feed roll 8 or the supply roll 10, the operator may rotate the rolls (or spindles) by hand. The motors (not shown) operatively connected to said spindles will behave as generators and the rotation generates an electromotive force in the motors opposing the rotation. Referring to the take-up spindle 4, the operator will rotate said spindle in the clockwise direction, which generates an electromotive force in the counterclockwise direction.

The control system of the take-up motor causes the motor to apply a torque in the clockwise direction that is proportional to said generated electromotive force. The motor thus drives take-up spindle in the direction in which the operator is trying to rotate.

Figure 4:
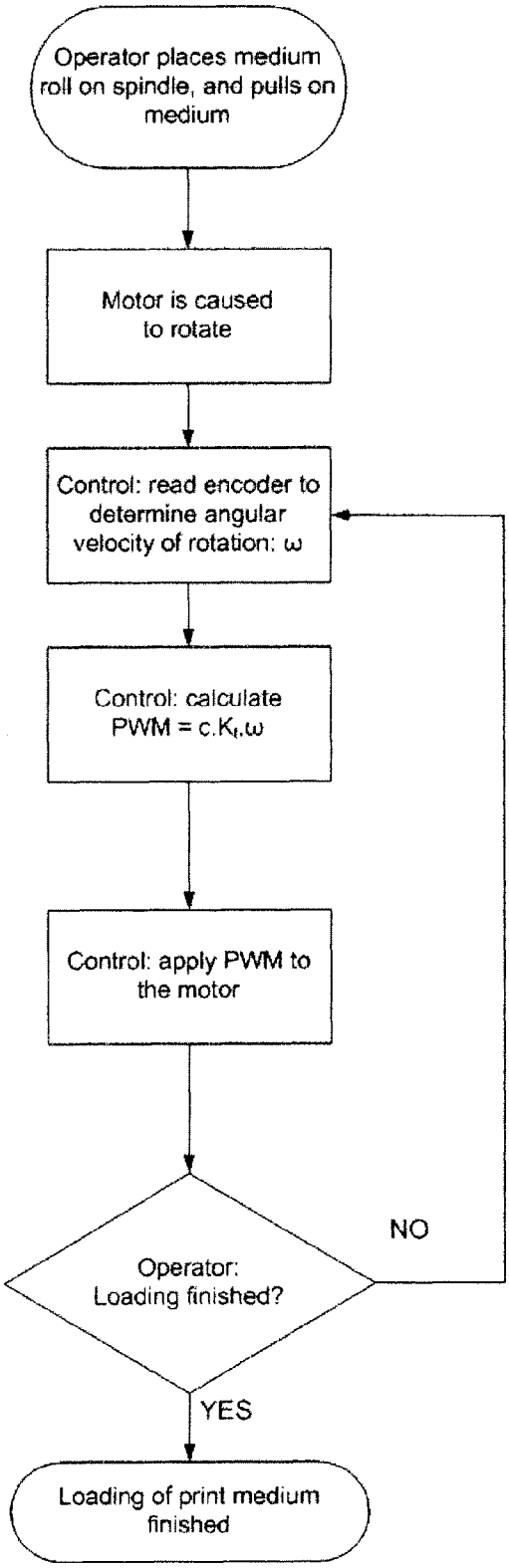
FIG. 4 is a flow chart indicating an embodiment of the method of assisting in handling a print medium according to the present invention.

FIG. 4 shows a flowchart of an embodiment of the method of loading a print medium in a printer according to the present invention. In this embodiment, the feed motor has been fitted with an encoder which can give the control system information about the angular position (and thus velocity) of the rotor. The control system of the motor furthermore uses Pulse Width Modulation (PWM) signals to control the motor. The PWM signal determines the power sent to the stator of the motor and thus determines the torque that the motor applies to the spindle connected to it.

In a first step of this method of loading a print medium, an operator places a medium roll on a feed spindle and pulls on the medium in order to load it through the remainder of the printer. This causes the feed motor, which is operatively connected to the feed spindle to rotate. Such a rotation causes an electromotive force to be generated in the motor, which is opposing said rotation.

The angular velocity of the motor is indicative of the amount of electromotive force generated in the motor. A Pulse Width Modulation (PWM) signal to be sent to the motor in this embodiment is calculated according to the following formula:

$PWM=c\cdot K_t\cdot\omega$. In this formula, $\omega$ is the angular velocity of the motor. $K_t$ is the electromotive force constant of the motor and indicates the relation between the velocity and the electromotive force of the motor. And c is a constant that determines which proportion of the electromotive force generated when the motor is being rotated by an outside force is compensated by the control system.

The PWM signal is thus proportional to the angular velocity and therefore also to the electromotive force generated by the user pulling on the medium. The constant c in the formula can be chosen; for example, it can be between 0 and 1. By choosing the constant to have a value between 0 and 1, the torque applied to the motor is always smaller than the electromotive force generated by the operator pulling on the medium. The feed motor is thus allowed to rotate, but still exerts a braking force on the medium. This allows the operator to maintain good control over the medium. If the value is chosen very small, the process of loading the print medium will be harder for the operator, he will have to exert a lot of force to rotate the feed motor and load the medium. Values for the constant between 0.8 and 0.95 have been found to significantly ease the loading process and allow the operator to maintain control over the print medium.

After the PWM signal has been calculated, it is applied to the motor, thus causing the motor to apply a torque to the feed spindle.

If the operator stops pulling, the motor will come to a stand still (since the feed motor was continuously braking the movement); this will happen when the loading has been completed. If the operator continues pulling on the medium, the process continues.

Although the above example was explained with reference to the feed spindle and feed motor, it should be clear that a similar method may also be used e.g. with a take-up spindle and take-up motor.

In other embodiments of the invention, instead of a control based on PWM signals, other types of control, e.g. using analogue voltage control may be used.

Also in other embodiments of the invention, the control may not be based on the angular velocity which is determined from an encoder fitted on the motor. The electromotive force generated in the motor when a spindle is being rotated by an outside force may be determined in alternative ways. For example, an additional small motor may be mounted on the same spindle as the feed motor. The electromotive force generated in this small additional motor may, after passing through an amplifier circuit, directly be applied, in the proper direction, to the feed motor to assist in a media handling operation. Since the electromotive force generated in the small additional motor will be proportional to the electromotive force generated in the feed motor when the spindle is rotated by an outside force (since they are subject to the same rotation), another simple way of controlling the feed motor is obtained.

Figure 5:
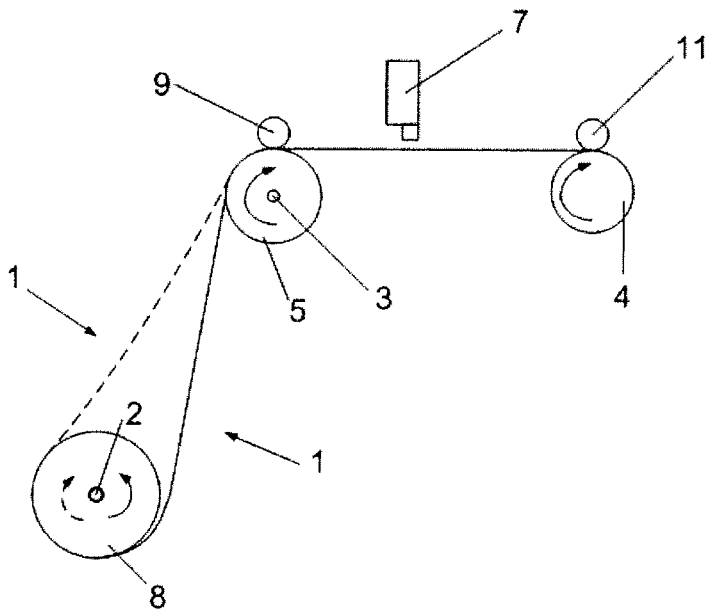
FIG. 5 illustrates a method of detecting the winding direction according to an embodiment of the present invention.

FIG. 5 describes another advantageous use of the method according to the present invention. A roll of print medium can be loaded on a spindle in different ways. For normal operation, it is important to know what the winding direction of the print medium roll 8 is, since a motor has to drive spindle 2 in a clockwise or a counterclockwise direction, depending upon the winding direction. In prior art systems, the user might provide this information through a user input interface, or simply would be instructed to always load the medium roll in such a way as to have the same winding direction. With the method according to the present invention, this is not necessary anymore.

According to the present invention, after loading the medium roll, the drive motor can be operated to rotate drive roller 5. This in turn causes the medium feed spindle 2 to rotate. Depending on the winding direction of the medium, the spindle will either rotate in the clockwise or counterclockwise direction. The electromotive force generated in the motor will then either be counterclockwise or clockwise respectively. Since the control system of the motor connected to the spindle is adapted to determine the electromotive force, it thus is able to deduct the media winding direction.

Once the medium winding direction has been determined, the printer is ready for its normal operation. The control system is able to cause the motor to rotate in the appropriate direction in normal use.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described before, but should be determined only by a fair reading of the claims that follow.

The invention claimed is:

1. A method of assisting in handling a print medium on a spindle, said spindle being operatively connected with a motor, said method comprising the following steps:

rotating said spindle by an outside force in a first direction when handling the print medium, said rotation generating an electromotive force opposing said rotation in said first direction, wherein said outside force is not from said motor; and causing the motor to apply a torque in said first direction, said torque based on and proportional to the electromotive force opposing said rotation in said first direction.

2. A method of assisting in handling a print medium according to claim 1, in which said motor operatively connected to the spindle is a DC motor fitted with an encoder and operated by Pulse Width Modulation (PWM) signals.

3. A method of assisting in handling a print medium according to claim 2, in which the PWM signals applied to the DC motor is proportional to an angular speed in said first direction captured from the encoder when said spindle is being rotated by said outside force.

4. A method of assisting in handling a print medium according to claim 1, wherein the outside force rotating the spindle in a first direction is applied by an operator pulling on the print medium.

5. A method of assisting in handling a print medium according to claim 1 when loading or unloading a print medium.

6. A method of assisting in handling a print medium according to claim 1, comprising the following steps:

driving a drive motor to advance the print medium, which causes said spindle to rotate, determining the electromotive force generated in the drive motor when said spindle is being rotated, and detecting a winding direction of the spindle based on the determined electromotive force.

7. A method of assisting in handling a print medium according to claim 1, comprising:

providing a printer with a print medium advance mechanism for advancing a print medium, said advance mechanism comprising at least a first spindle upon with a print medium can be loaded, a first motor operatively connected to said first spindle, and a control system, said control system being adapted to determine an amount of electromotive force generated in the first motor when said first spindle is being rotated by an outside force, wherein said electromotive force opposes rotation of said first spindle, and, said control system being adapted to, in an assisted media handling operation, cause the first motor to apply a torque based on and proportional to said determined electromotive force, and a second spindle upon which a print medium can be loaded and a second motor operatively connected to said second spindle, said control system being adapted to determine an amount of electromotive force generated in the second motor when said second spindle is being rotated by an outside force and, said control system being adapted to, in an assisted media handling operation, cause the second motor to apply a torque proportional to said determined electromotive force, wherein said first spindle is a print medium feed spindle, from which a print medium is unwound upstream of a printhead, and said second spindle is a print medium take-up spindle, upon which the print medium is wound downstream of a printhead, said printer further comprising a drive roller, operatively connected to a drive motor, said drive roller, in normal operation, accurately advancing the print medium with respect to the printhead;

driving the drive motor to advance the print medium, which causes said first spindle to rotate, the control system determining the electromotive force generated in the first motor when said first spindle is being rotated, and the control system detecting a winding direction of the spindle based on the determined electromotive force.

8. A print medium advance mechanism for advancing a print medium, said advance mechanism comprising at least a first spindle upon which a print medium can be loaded, a first motor operatively connected to said first spindle, and a control system, said control system being adapted to determine an amount of electromotive force generated in the first motor when said first spindle is being rotated by an outside force, wherein said electromotive force opposes rotation of said first spindle, and wherein said outside force is not from said motor and, said control system being adapted to, in an assisted media handling operation, cause the first motor to apply a torque based on and proportional to said determined electromotive force.

9. A print medium advance mechanism according to claim 8, further comprising a second spindle upon which a print medium can be loaded and a second motor operatively connected to said second spindle, said control system being adapted to determine an amount of electromotive force generated in the second motor when said second spindle is being rotated by an outside force and, said control system being adapted to, in an assisted media handling operation, cause the second motor to apply a torque proportional to said determined electromotive force.

10. A print medium advance mechanism according to claim 9, wherein the control system comprises a first motor control system for controlling the first motor and a second motor control system for controlling the second motor.

11. An inkjet printer comprising a print medium advance mechanism according to claim 9.

12. A printer according to claim 11, wherein said first spindle is a print medium feed spindle, from which a print medium is unwound upstream of a printhead, and said second spindle is a print medium take-up spindle, upon which the print medium is wound downstream of a printhead, said printer further comprising a drive roller, operatively connected to a drive motor, said drive roller, in normal operation, accurately advancing the print medium with respect to the printhead.

13. A printer according to claim 12, wherein, in normal operation, the first motor and second motor follow velocity profiles based on the velocity profile of the drive motor.

14. A printer according to claim 13, said printer further comprising a user interface which allows the user to set the printer in an assisted media handling mode or a normal operation mode, in which in the assisted media handling mode for the first and second motor, the control system determines the amount of electromotive force generated in a motor when a spindle is being rotated by an outside force and causes the motor to apply a torque proportional to said determined electromotive force, and in which in the normal operation mode, the first and second motor follow a velocity profile based on the velocity profile of the drive motor.

15. A print medium advance mechanism according to claim 8, wherein the first motor operatively connected to the spindle is a DC motor fitted with an encoder.

16. A print medium advance mechanism according to claim 15, wherein the control system determines the amount of electromotive force generated in the first motor when said first spindle is being rotated by an outside force by measuring an angular speed captured from the encoder.

17. A printer comprising a print medium advance mechanism according to claim 16.

* * * * *